US010328738B2

(12) United States Patent
Machizaud et al.

(10) Patent No.: US 10,328,738 B2
(45) **Date of Patent: *Jun. 25, 2019**

(54) SECURITY ELEMENT COMPRISING A MASKING STRUCTURE CONTAINING A MIXTURE OF NANOMETRIC FILLERS

(71) Applicant: OBERTHUR FIDUCIAIRE SAS, Paris (FR)

(72) Inventors: Jacques Machizaud, Voiron (FR); Aurelie Maman, Chasselay (FR); Michel Camus, Rives (FR)

(73) Assignee: OBERTHUR FIDUCIAIRE SAS, Paris (FR)

( * ) Notice: Subject to any disclaimer, the term of this patent is extended or adjusted under 35 U.S.C. 154(b) by 239 days.

This patent is subject to a terminal disclaimer.

(21) Appl. No.: 14/783,868

(22) PCT Filed: Apr. 10, 2014

(86) PCT No.: PCT/IB2014/060625
§ 371 (c)(1),
(2) Date: Oct. 11, 2015

(87) PCT Pub. No.: WO2014/167527
PCT Pub. Date: Oct. 16, 2014

(65) Prior Publication Data

US 2016/0059611 A1 Mar. 3, 2016

(30) Foreign Application Priority Data

Apr. 11, 2013 (FR) ..... 13 53252

(51) Int. Cl.

| | |
|---|---|
| ***B42D 25/355*** | (2014.01) |
| ***D21H 17/67*** | (2006.01) |
| ***D21H 21/44*** | (2006.01) |
| ***D21H 21/48*** | (2006.01) |
| ***D21H 21/52*** | (2006.01) |
| ***B42D 25/378*** | (2014.01) |

(52) U.S. Cl.
CPC ..... *B42D 25/355* (2014.10); *B42D 25/378* (2014.10); *D21H 17/67* (2013.01);
(Continued)

(58) Field of Classification Search
CPC .... B42D 25/355; B42D 25/378; D21H 17/67; D21H 21/44; D21H 21/48; D21H 21/52
(Continued)

(56) References Cited

U.S. PATENT DOCUMENTS

| | | | |
|---|---|---|---|
| 3,858,977 | A | 1/1975 | Baird et al. |
| 4,017,326 | A | 4/1977 | Davis |

(Continued)

FOREIGN PATENT DOCUMENTS

| | | | |
|---|---|---|---|
| AU | 2011276149 | A1 | 2/2013 |
| CN | 1264340 | A | 8/2000 |

(Continued)

OTHER PUBLICATIONS

Wacker Silicones (Perfect Toners Hide a Secret: HDK®—Pyrogenic Silica.*

(Continued)

*Primary Examiner* — Holly C Rickman
*Assistant Examiner* — Linda N Chau
(74) *Attorney, Agent, or Firm* — Jones Robb, PLLC

(57) ABSTRACT

A security element, preferably a security wire, for a secure document, may include a masking structure for reducing the visibility of a surface of the element when the latter is located inside the document or on the surface thereof, the masking structure comprising a mixture of at least two nanometric fillers.

23 Claims, 1 Drawing Sheet

(52) U.S. Cl.
CPC ..... *D21H 21/44* (2013.01); *D21H 21/48* (2013.01); *D21H 21/52* (2013.01)

(58) Field of Classification Search
USPC ..... 283/111
See application file for complete search history.

(56) References Cited

U.S. PATENT DOCUMENTS 4,307,899 A 12/1981 Hoppe
4,442,170 A 4/1984 Kaule et al.
4,451,521 A 5/1984 Kaule et al.
4,452,843 A 6/1984 Kaule et al.
4,462,867 A 7/1984 Fuller
4,892,336 A 1/1990 Kaule et al.
4,941,687 A 7/1990 Crane
5,068,008 A 11/1991 Crane
5,087,507 A 2/1992 Heinzer
5,275,870 A 1/1994 Halope et al.
5,354,099 A 10/1994 Kaule et al.
5,424,119 A 6/1995 Phillips et al.
5,516,153 A 5/1996 Kaule
5,573,584 A 11/1996 Ostertag et al.
5,573,639 A 11/1996 Schmitz et al.
5,697,649 A 12/1997 Dames et al.
5,871,833 A * 2/1999 Henbo ..... B32B 27/20 101/32
5,876,068 A 3/1999 Schneider et al.
5,922,465 A 7/1999 Gailberger et al.
5,944,927 A 8/1999 Seifert
5,985,424 A * 11/1999 DeMatte ..... B41M 5/506 428/212
6,036,232 A 3/2000 Kaule et al.
6,165,592 A 12/2000 Berger et al.
6,210,777 B1 4/2001 Vermeulen et al.
6,318,758 B1 11/2001 Stenzel et al.
6,472,455 B1 10/2002 Bleikolm et al.
6,474,695 B1 11/2002 Schneider et al.
6,490,090 B1 12/2002 Kumazawa et al.
6,491,324 B1 12/2002 Schmitz et al.
6,517,628 B1 2/2003 Pfaff et al.
6,565,770 B1 5/2003 Mayer et al.
6,596,070 B1 7/2003 Schmidt et al.
6,747,073 B1 6/2004 Pfaff et al.
6,767,633 B2 7/2004 Steudel et al.
6,815,065 B2 11/2004 Argoitia et al.
2002/0022093 A1 2/2002 Kuntz et al.
2002/0025418 A1 2/2002 Ishibashi et al.
2002/0056758 A1 5/2002 Stenzel et al.
2002/0141957 A1 10/2002 Tan et al.
2003/0008120 A1 1/2003 Andes et al.
2003/0012935 A1 1/2003 Kuntz et al.
2003/0104206 A1 6/2003 Argoitia et al.
2003/0194578 A1 10/2003 Tam et al.
2004/0023008 A1* 2/2004 Rosset ..... D21H 19/40 428/195.1
2004/0144023 A1 7/2004 Bruckner et al.
2004/0151827 A1 8/2004 Argoitia et al.
2004/0151880 A1 8/2004 Nakamura et al.
2004/0191198 A1 9/2004 Hochstein et al.
2005/0052519 A1 3/2005 Mayer et al.
2005/0063067 A1 3/2005 Phillips et al.
2005/0151368 A1 7/2005 Heim
2005/0158526 A1 7/2005 Ino et al.
2005/0253374 A1 11/2005 Payne et al.
2006/0032404 A1 2/2006 Kniess
2006/0097511 A1 5/2006 Keller
2006/0163371 A1 7/2006 Veil
2006/0231225 A1 10/2006 Lejeune
2007/0006127 A1 1/2007 Kuntz et al.
2007/0028799 A1 2/2007 Kniess et al.
2007/0039521 A1 2/2007 Zimmermann et al.
2007/0095929 A1 5/2007 Cote et al.
2007/0206249 A1 9/2007 Phillips et al.
2007/0246933 A1 10/2007 Heim et al.
2007/0264476 A1 11/2007 Bala et al.
2007/0281177 A1 12/2007 Haubrich et al.
2008/0024847 A1 1/2008 Kittler et al.
2008/0030020 A1 2/2008 Mallol et al.
2008/0129036 A1 6/2008 Seki et al.
2008/0207772 A1* 8/2008 Kniess ..... A61K 8/19 514/769
2009/0230670 A1 9/2009 Schmid et al.
2009/0258200 A1 10/2009 Scholz et al.
2010/0015337 A1 1/2010 Becker et al.
2010/0060987 A1 3/2010 Witzman et al.
2010/0112314 A1 5/2010 Jiang et al.
2010/0194093 A1 8/2010 Macpherson
2010/0213698 A1 8/2010 Snelling et al.
2010/0230615 A1 9/2010 MacPherson et al.
2010/0266647 A1 10/2010 Dingley et al.
2010/0295287 A1 11/2010 Reichert et al.
2010/0295291 A1* 11/2010 Rancien ..... D21H 21/40 283/113
2011/0018252 A1 1/2011 Petry et al.
2011/0174884 A1 7/2011 Endres et al.
2011/0239885 A1 10/2011 Marchant et al.
2012/0170124 A1 7/2012 Fuhse et al.
2012/0228860 A1 9/2012 Rauch et al.
2012/0229368 A1 9/2012 Watanabe et al.
2013/0087622 A1 4/2013 Collins et al.
2014/0103632 A1 4/2014 Camus et al.
2015/0224809 A1 8/2015 Tompkin et al.
2015/0314629 A1 11/2015 Ritter et al.
2016/0059611 A1 3/2016 Machizaud et al.
2016/0075165 A1 3/2016 Machizaud et al.
2016/0325578 A1 11/2016 Ritter et al.

FOREIGN PATENT DOCUMENTS

CN 1628039 A 6/2005
EP 0498186 A1 8/1992
EP 0500726 B1 9/1992
EP 756945 A1 2/1997
EP 0803550 A2 10/1997
EP 1609619 A2 12/2005
EP 2075767 A1 7/2009
EP 2219168 A2 8/2010
FR 2764314 A1 12/1998
FR 2803939 A1 7/2001
FR 2871174 A1 12/2005
JP H07056377 A 3/1995
JP 09169161 A 6/1997
JP H10100573 A 4/1998
JP H11323785 A 11/1999
JP 2002088689 A 3/2002
JP 2002266288 A 9/2002
JP 2002285061 A 10/2002
JP 2005015963 A 1/2005
JP 2006161224 A 6/2006
JP 2007216602 A 8/2007
WO 9516224 A1 6/1995
WO 9723357 A1 7/1997
WO 03044276 A1 5/2003
WO 03054259 A1 7/2003
WO 2004040062 A1 5/2004
WO 2005124022 A2 12/2005
WO 2010040444 A1 4/2010
WO 2012003947 A1 1/2012
WO 2012054053 A1 4/2012
WO 2012164054 A1 12/2012
WO 2013093848 A1 6/2013
WO 2014167512 A1 10/2014
WO 2014167527 A1 10/2014

OTHER PUBLICATIONS

PCT/IB2014/060625 PCT International Search Report dated Oct. 16, 2014.
PCT/IB2014/060625 PCT Written Opinion of the ISA dated Oct. 11, 2015
PCT/IB2014/060625 PCT International Preliminary Report on Patentability Chapter I dated Oct. 13, 2015.

(56) References Cited

OTHER PUBLICATIONS

PCT/IB2014/060560 PCT International Search Report dated Oct. 16, 2014.
PCT/IB2014/060560 PCT Written Opinion of the ISA dated Oct. 11, 2015.
PCT/IB2014/060560 PCT International Preliminary Report on Patentability Chapter I dated Oct. 13, 2015.
Non-Final Office Action in corresponding U.S. Appl. No. 14/783,703, dated Oct. 27, 2017.
Office Action in CN Appln No. 201480033261.1 dated Dec. 15, 2017.
Office Action in CN Application No. 201480033256.0, dated Aug. 30, 2016.
Falbe and Regitz, Römpp Lexikon der Chemie, Edition 10, pp. 2150-2153 and 3019-3020, Georg Thieme Verlag, 1997.

* cited by examiner

SECURITY ELEMENT COMPRISING A MASKING STRUCTURE CONTAINING A MIXTURE OF NANOMETRIC FILLERS

This application is a national stage application of International PCT Application No. PCT/IB2014/060625, filed internationally on Apr. 10, 2014, which claims priority to French Application No. FR 13 53252, filed Apr. 11, 2013, the entire contents of each of which is incorporated by reference herein in its entirety.

The present invention relates to security elements and especially those intended for secured documents.

The expression "secured document" is understood to mean a means of payment, such as a banknote, a check or a meal ticket, an identity document, such as an identity card, a visa, a passport or a driving license, a lottery ticket, a travel ticket or pass, a revenue stamp, or even a ticket for entrance to a cultural or sporting event.

It is known to integrate a security thread into a paper substrate. This thread is either inserted entirely into the bulk of the paper or as a variant at least partially on the surface thereof, especially in a window. This thread generally comprises a text that appears under transmitted light, sometimes also referred to as CLEARTEXT®. Outside any window(s), it is preferable for the thread not to be visible in reflection, in order not to adversely affect the appearance of the document and not to hinder the visibility of the printings borne by the substrate. In addition, this provides an additional security measure, the thread and its text being hard or impossible to see under reflected light and visible under transmitted light.

To decrease the visibility of the thread, a plurality of solutions already exist.

A first solution consists in using a very reflective thread, obtained by depositing a relatively large thickness of metal, allowing a high optical density to be obtained. However, to obtain particular optical effects, especially based on the semi-transparency of the metal layer, certain security elements require metal layers, for example of aluminum, of low optical density.

A second solution consists in applying a masking layer to the thread. The use of a masking layer made of titanium dioxide, zinc oxide or other particles makes it possible to make the verso of the thread a matte white color, decreasing the metallic aspect of the thread. These layers are in general of small thickness and do not allow a security thread to be optimally masked. In addition, the increase in the thickness of such layers affects the visibility of the CLEARTEXT® under transmitted light.

US 2010/0213698 A1 discloses a solution of this type. The masking layer has light scattering properties similar to those of paper.

If the masking layer uniformly covers one face of the thread, its opacity decreases the visibility of the text under transmitted light. It is possible to deposit the masking layer only on the metal, but this complicates the manufacturing process. In addition, the masking layer may form a screen to UV and thus hamper the use of luminescent layers within the thread.

A third solution for decreasing the visibility of the thread consists in producing a masking layer taking the form of a continuous or half-tone semi-reflective metal layer. The drawback of this solution is that it decreases the visibility of the text.

FR 2 871 174 discloses a document comprising an information vector and a strip-shaped masking element.

US 2002/0056758 discloses an opaque protective layer applied to both faces of a magnetic layer. This opaque layer may contain iridescent pigments. One variant consists in printing the thread with an opaque ink, for example containing titanium dioxide, which does not let UV radiation pass, or optically variable pigments.

US 2008/0030020 describes a security document comprising a semi-reflective coating containing iridescent pigments, such as particles based on mica, which are non-nanoscale micron-sized particles. In addition, such pigments have a relatively high opacity.

US 2010/0213698 A1 discloses a security element.

US 2005/0151368 A1 discloses a silicon layer associated with other layers so as to form an interferential structure.

U.S. Pat. No. 5,876,068 describes a reflective metal layer applied to the entire surface of the thread.

Moreover, it is also known to apply, to security threads, a metal layer covered with a thin masking layer that is white or comprises a mattifying agent. Such a masking layer enables the operation of certain papermaking machine detectors, especially detectors of twisting of the security threads. By decreasing the reflection of the metal layer, the thin masking layer makes the thread more visible in reflection. In addition, increasing the thickness of the masking layer decreases the visibility of the CLEARTEXT® under transmitted light.

There is a need for a security element that while being less visible under reflected light does not unduly degrade the legibility of information associated with the security element under transmitted light.

The invention achieves this aim by virtue of a security element, preferably taking the form of a security thread, for a secured document, comprising:

- a masking structure intended to decrease the visibility of a surface of the element when the latter is present within the document or on its surface, the masking structure comprising a mixture of at least two nanoscale fillers.

By virtue of the invention, the security element may be made less visible in the one or more zones in which its visibility would adversely affect the appearance of the document, because of the presence of the masking structure, which for example extends over at least the entirety of one face of the element.

The expression "at least two nanoscale fillers" is especially understood to mean nanoscale fillers of different natures.

The expression "nanoscale filler" is understood to mean a filler of one or more pulverulent compounds, the D50 average size of which is comprised between 1 nm and 1000 nm. Preferably, at least one of the fillers consists of a single particular material, which is preferably transparent to UV radiation. The two fillers may each consist of a single particular material, these materials being different.

In particular, the security element may comprise at least one luminescent agent, at least one of the nanoscale fillers being at least partially, and preferably completely, transparent to UV radiation, especially UV radiation useful for luminescence. In this case, the nanoscale filler that is at least partially transparent to UV is present in an amount by weight comprised between 20 and 80%, better still between 30 and 70% and even better still between 40 and 60%, relative to the weight of the masking structure. All the weights are dry weights, unless otherwise indicated.

Nanoscale fillers such as silica, titanium dioxide, calcium carbonate, barium sulfate and zinc oxide may be used.

The nanoscale size of said at least two fillers makes it possible to increase the scattering of light within the masking structure. Such fillers scatter wavelengths corresponding to visible light, thereby making it possible to obtain an effect of masking of the security element located under the masking structure.

Preferably one of the and more preferably both of the nanoscale fillers has/have a D50 size comprised between 30 and 1000 nm, better still between 30 and 500 nm and even better still between 50 and 300 nm.

Said at least two nanoscale fillers preferably differ at least by their refractive index. Preferably said at least two nanoscale fillers have refractive indices that differ by at least 0.5 and more preferably at least 0.8.

Thus, mixing thereof leads to an amplification of the light scattering effect and allows optimal masking to be obtained, especially for a given thickness of the masking structure.

Without wanting to be tied to one theory, the Applicant believes that mixing said at least two nanoscale fillers of different refractive indices allows the scattering effect to be amplified because the nanoscale filler of lower refractive index poorly refracts incident light that then follows a longer optical path and penetrates further into the masking structure, whereas the nanoscale filler of higher refractive index increases the number of times light is scattered within the masking structure. Thus both high penetration and substantial scattering of light within the masking structure is obtained, thus allowing said security element to be masked in reflection without the masking structure being opaque, which would adversely affect the visibility of the security element under transmitted light.

The masking structure preferably takes the form of a single masking layer containing said mixture of at least two nanoscale fillers.

Again preferably, at least one of the nanoscale fillers comprises colloidal and especially pyrogenated silica (silicon dioxide) and better still consists of pyrogenated colloidal silica. A silica-comprising nanoscale filler is advantageous because it has the advantage of not absorbing UV radiation useful to luminescence, thereby making it possible to produce the security element with one or more layers that luminesce, and especially fluoresce, under UV.

One of the nanoscale fillers of the mixture, and preferably the colloidal silica, may be present in an amount by weight comprised between 20 and 80%, better still between 30 and 70% and even better still between 40 and 60% relative to the weight of the masking structure.

The colloidal silica preferably has a D50 size comprised between 30 and 1000 nm, better still between 30 and 500 nm and even better still between 50 and 300 nm.

The security element may comprise, by way of nanoscale filler, titanium dioxide in the masking structure. Preferably, the amount of titanium dioxide is small enough not to unduly absorb UV radiation and to make it possible to use within the security element at least one luminescent compound, which is especially fluorescent under UV (365 nm), for example applied by printing or mixed into the masking layer or into a lacquer or into an adhesive of the security element.

The titanium dioxide is preferably of anatase nature, because it then has the advantage of absorbing UV more weakly relative to titanium dioxide of rutile nature. The anatase titanium dioxide is especially at least partially transparent to UV and, in particular transparent to at least one wavelength range in the UV domain.

The other of the nanoscale fillers of the mixture, and preferably the titanium dioxide, may be present in an amount by weight comprised between 1 and 40%, better still between 2 and 30% and even better still between 3 and 15% relative to the weight of the masking structure.

The titanium dioxide preferably has a D50 size comprised between 30 and 1000 nm, better still between 30 and 500 nm and even better still between 50 and 300 nm.

According to a preferred variant, said at least two nanoscale fillers are colloidal and preferably pyrogenated silica and titanium dioxide, especially titanium dioxide in anatase form, respectively.

According to this variant, the colloidal silica induces more substantial scattering of the light at short (blue) wavelengths and therefore a dominant red/orangey color is obtained in transmission (and therefore in specular reflection if the particles are placed on a layer that is at least partially reflecting). The titanium dioxide makes it possible to modify the path followed by the light by increasing scattering within the masking structure, thereby increasing opacity and thus decreasing the red/orangey reflective aspect produced by the colloidal silica.

According to one preferred variant the masking structure furthermore comprises a multilayer interferential pigment.

The multilayer interferential pigment has the particularity of preferably selecting certain wavelengths in reflection and in transmission. For example, a blue iridescent pigment reflects in the specular direction (angle of reflection equal to the angle of incidence) more at blue wavelengths than at others. In transmission, the color obtained is then complementary to the color in reflection, i.e. red/orangey. The multilayer interferential pigments may be relatively transparent, because they are weakly absorbent, and therefore a layer of multilayer interferential pigments will have, in diffuse reflection (in all the other directions other than the specular direction) the same color as in transmission (complementary to the specular color in reflection). Taking again the above example, a layer of blue iridescent pigments spread over a piece of white paper will yield a red/orangey color.

The expression "multilayer interferential pigment" is understood to mean a pigment that produces a color via an interference effect by virtue of a succession, on the path followed by the light, of at least two materials of different refractive indices. A multilayer interferential pigment is even sometimes qualified as a "nacre" in the case of layers deposited on a platelet base. A multilayer interferential pigment is different from a liquid crystal, which may also generate a color via an interference effect because of its intrinsic structure.

By combining the color associated with the scattering of light by the nanoscale fillers and the color associated with diffuse reflection by the multilayer interferential pigment, it is possible to obtain, by additive color mixing, a color, for example white, substantially similar to that of the substrate, by suitably choosing the color of the pigment and that of the filler; preferably, a multilayer interferential pigment that is blue, green or blue-green, or even a mixture of green and blue pigments, is combined with the nanoscale fillers.

The combination of the pigment and the nanoscale fillers reinforces the scattering of incident light within the masking structure, and decreases the visibility in reflection of the security element. This combination also makes it possible to limit the proportion of the nanoscale filler having the highest refractive index, especially titanium dioxide, and therefore to limit the opacification under transmitted light and, if relevant, the absorption of UV.

Preferably, the multilayer interferential pigment according to the invention comprises a transparent and preferably mineral base coated with at least one layer of a material of different refractive index to that of the base. The pigment may comprise a platelet base that is preferably made of mica or glass. For example, the pigment comprises mica or silica (silicon dioxide) coated with titanium dioxide.

The pigment preferably has a transparent substrate that is for example made of mica, and especially optical properties that are complementary to those of the colloidal pyrogenated silica. When the substrate is white, the pigment is preferably blue or green or blue-green. The color of the pigment is that obtained in specular reflection at non-normal incidence.

Preferably, as explained above, the interferential pigment has a blue, green or blue-green color.

The D50 average size of the pigment is preferably comprised between 2 and 150 microns, better still between 5 and 40 microns and even better still between 5 and 25 microns.

The multilayer interferential pigment may be non-goniochromic, and comprise for example only a single layer coating a base.

The amount by weight of multilayer interferential pigment relative to the weight of the masking structure is preferably comprised between 1 and 40%, better still between 2 and 30% and even better still between 5 and 15%.

Although the security element is preferably a security thread, the invention is still advantageous when the security element is a foil or a flake or another security element.

The security element may have two opposite major faces and the masking structure may be placed so as to decrease the visibility of at least one of said faces. For example, the masking structure covers a carrier of the security element on one of its sides. The masking structure may take the form of a continuous coating without openings, by virtue of the low opacity of the filler and of the pigment. Thus, manufacturing of the security element is facilitated. The masking structure may cover transparent or translucent zones of a security structure borne by the security element, and opaque zones of the security structure.

The thickness of the masking structure, especially when the latter takes the form of a single layer, may be comprised between 2 and 30 microns, better still between 5 and 20 microns and even better still between 8 and 13 microns.

The nanoscale fillers and if relevant the multilayer interferential pigment may be dispersed in a binder, which may be of any type, and especially be applied in the fluid state to the element during its manufacture. This binder may be cross-linked on drying or under UV radiation.

The security element comprises a security structure according to the invention which may be produced in various ways but preferably the security structure comprises an opaque layer, especially printed or deposited by a vacuum deposition process, and at least one opening in this opaque layer. Particularly advantageously, the security structure is reflective and especially comprises a metallization/demetallization. It is preferably a question of a reflective security structure of low optical density, especially associated with subjacent opaque layers. The metal is for example aluminum, gold, copper, iron, silver, chromium, nickel, zinc, cadmium, bismuth and alloys and oxides thereof. Openings taking the form of text, for example of a negative script, are formed conventionally in the metal by demetallization.

Preferably, the security element according to the invention comprises a carrier, especially made of a thermoplastic material and preferably of PET or polyester. This carrier is preferably entirely transparent.

The security structure may be located on one side of the carrier and the masking structure on the other side. The security structure and the masking structure may also both be located on the same side of the carrier. The masking structure may even be present twice on the security element, on each side of the carrier, which may be desirable in order to mask a magnetic thread for example.

The security element may comprise a luminescent and especially fluorescent agent, for example applied by printing, mixed into a lacquer or into an adhesive of the security element or preferably incorporated into the masking structure and more preferably mixed into a masking layer comprising the multilayer interferential pigment and the nanoscale filler.

The security element may comprise a heat-sealing adhesive especially making contact with the masking structure. The adhesive may comprise a luminescent agent and especially one that is fluorescent under UV.

The security element may comprise a luminescent agent, preferably one that is fluorescent under UV, within a layer distinct from the masking structure, preferably within a layer located opposite the security structure relative to the carrier, when the latter exists.

Another subject of the invention, according to another of its aspects, is a secured document incorporating a security element according to the invention. The security element is for example incorporated into the bulk, into a window or on the surface of the substrate of the document. The masking structure may be present on the verso of the security element, when the window is located on the recto thereof.

The security element may or not extend from one edge to the other of the document.

The document may comprise one or more additional security elements such as defined below.

Among the additional security elements, certain ones are detectable by eye, under daylight or under artificial light, without use of a particular apparatus. These additional security elements for example comprise colored flakes or fibers and/or partially or completely metallized or printed threads. These additional security elements are what are called level one security elements.

Other types of additional security elements are detectable only using a relatively simple apparatus, such as a lamp emitting in the ultraviolet (UV) or infrared (IR). These additional security elements for example comprise fibers, flakes, strips, threads or particles. These security elements may or may not be visible to the naked eye, for example being luminescent under the illumination of a Wood's lamp emitting at a wavelength of 365 nm. These security elements are what are called level two security elements.

To be detected, other types of additional security elements require a more sophisticated apparatus. These security elements are for example capable of generating a specific signal when they are subjected, whether simultaneously or not, to one or more sources of external excitation. Automatic detection of the signal makes it possible to authenticate, if needs be, the document. These additional security elements for example comprise tracers taking the form of active materials, particles or fibers, that are capable of generating a specific signal when these tracers are subjected to an optronic, electrical, magnetic or electromagnetic excitation. These additional security elements are what are called level three security elements.

The one or more additional security elements present within the document may have level one, two or three security properties.

Yet another subject of the invention, according to another of its aspects, is a method for authenticating a document such as defined above, in which the security element is observed under transmitted light. The observation may be carried out through a window in the document.

Yet another subject of the invention, according to another of its aspects, is a process for manufacturing a document such as defined above, in which the security element is incorporated into a window or the surface of the document.

The invention will be better understood on reading the following detailed description of nonlimiting exemplary embodiments thereof, and on examining the appended drawings, in which:

FIG. 1 schematically shows an exemplary secured document according to the invention;

In the figures, the actual respective proportions of the various constituent elements have not always been respected, for the sake of the clarity of the drawings. In addition, certain layers may have been shown as monolayers in the figures whereas in fact they are made up of a plurality of sublayers. Adhesive layers may not have been shown between various constituent layers.

Figure 1:
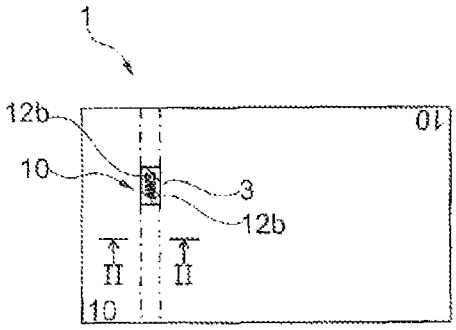
Figure 7:
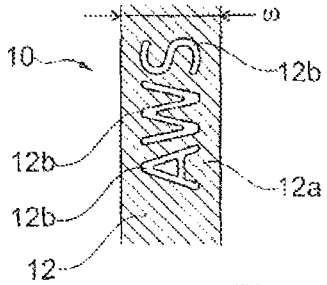
FIG. 7 shows in isolation and from above the security element in FIG. 2.

FIG. 1 shows an exemplary secured document 1 according to an exemplary implementation of the invention.

The document 1 comprises a substrate 2, preferably made of paper, formed from one or more plies.

The document 1 integrates a security element 10 according to the invention, taking the form of a thread in the example in question.

The security element 10 comprises a carrier 11 made of a thermoplastic material, which ensures the mechanical strength of the thread. This carrier 11 is for example made of a transparent thermoplastic material such as PET or polyester. The thickness e of the carrier 11 for example ranges from 6 to 30 μm and the width w of the element 10 from 1 to 10 mm.

The security element 10 comprises a security structure 12, for example formed by metallization/demetallization. The security structure 12 thus comprises, for example, an opaque metal layer 12*a* and openings 12*b* taking the form of letters or other recognizable patterns. These openings 12*b* are visible under light transmitted through a window 3 in the document 1. The security structure 12 may also form a recognizable half-tone image, the subject of which is for example moreover present on the document. Although the security structure preferably comprises a metallization/demetallization, it may also comprise printed patterns, for example printed with a metallic, magnetic or electrically conductive ink.

Figure 2:
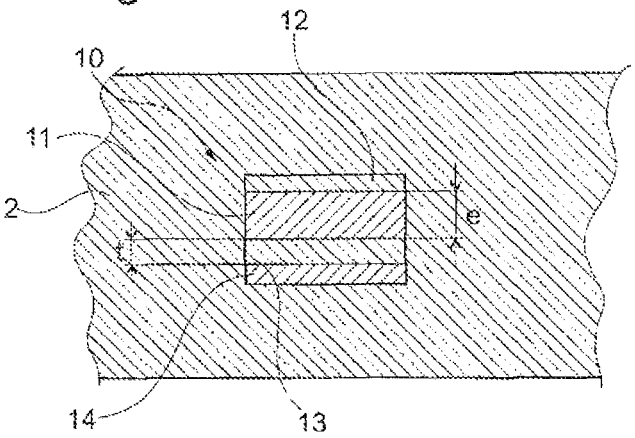
FIG. 2 shows in transverse cross section along II-II the secured document and the security element.

The security element 10 comprises a masking structure 13, for example, as illustrated in FIG. 2, taking the form of a single layer located opposite the security structure 12 relative to the carrier 11.

The security element 10 may also comprise a layer of a heat-sealing adhesive 14, preferably located, as illustrated, on an external face of the element 10, for example on the side opposite the security structure 12 relative to the carrier 11. The element 10 may comprise a heat-sealing adhesive layer on each of its external faces.

The layer 14 may comprise a luminescent and especially fluorescent agent. The masking structure 13 makes it possible to decrease the visibility of the element in the substrate 2 while preserving the transparency of the patterns 12*b* in transmission, and the transparency to UV if required.

The invention makes it possible to avoid a problem with excessive thickness within the substrate, because the masking structure 13 may be of relatively small thickness t.

The invention, by virtue of the presence of the masking layer 13, allows a metal layer of relatively low optical density to be used to produce the security structure 12, without this in any way making the thread too visible in reflection.

The masking structure 13 comprises, according to the invention, a mixture of at least two nanoscale fillers.

Preferably, the masking structure 13 comprises colloidal pyrogenated silica, the size of the particles of which is nanoscale, combined with nanoscale titanium dioxide, for example Rutile PGG 121 titanium dioxide from the company Cristal, the D50 particle size of which is smaller than 220 nm.

The colloidal pyrogenated silica consists of silica nanoparticles, the size of which is smaller than 120 nm for half of the particles.

The size of the silica particles is preferably comprised between 30 nm and 1000 nm, again preferably between 30 and 500 nm and more preferably between 50 and 300 nm.

The thickness t of the masking layer is preferably comprised between 2 and 30 μm, again preferably between 5 and 20 μm and better still between 8 and 13 μm.

The amount by weight of colloidal pyrogenated silica relative to the weight of the masking structure is preferably comprised between 20 and 80%, better still between 30 and 70% and preferably between 40 and 60%.

The amount by weight of titanium dioxide relative to the weight of the masking structure is preferably comprised between 1 and 40%, better still between 2 and 30% and preferably between 3 and 15%.

EXAMPLE

A masking layer 13 having the following composition is used:

- nanoscale filler Aerodisp W7330N from Evonik: 50% by dry weight;
- nanoscale filler Rutile PGG 121 from Cristal: 10% by dry weight; and
- binder Cromelastic SE871 from Cromogenia-Units: 40% by dry weight.

This layer may be applied by rotogravure (or roto-coating) in the form of a coating of uniform thickness of 10 microns.

Figure 4:
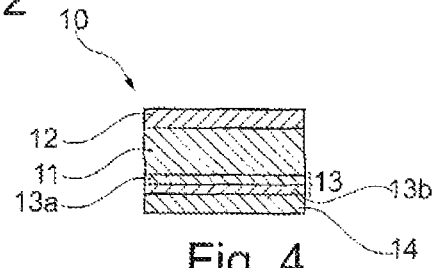

In this example, the security structure 12 is a layer of aluminum of 300 nm thickness, with a text in negative script, as illustrated in FIG. 4. The carrier 11 is made of PET.

In one variant, above the metal layer of the security structure 12, at least one optically variable layer (called an OVI) may also be deposited. This additional layer (not shown) for example comprises liquid crystals, iridescent pigments and/or interferential layers or structures such as a hologram.

The security element may also comprise a magnetic coating, for example in the form of a code.

Generally, a multilayer interferential pigment may be added to the masking layer 13, in small amounts, in order to increase the scattering of light. In this case, the following composition may be substituted for the preceding one:

- nanoscale filler Aerodisp W7330N from Evonik: 50% by dry weight;

nanoscale filler Rutile PGG 121 from Cristal: 6% by dry weight;

iridescent pigment of reference 221 from Merck: 6% by dry weight; and binder Cromelastic SE871 from Cromogenia-Units: 38% by dry weight.

Figure 3:
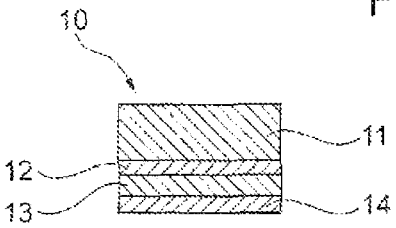
FIGS. 3 and 4 show in transverse cross section along II-II variants of the security element.

FIG. 3 illustrates the possibility for the security structure 12 and the masking structure 13 to be located on the same side of the carrier 11. The other face of the carrier may receive any additional security measure, for example a luminescent compound, an optically variable structure, a holographic structure or a structure based on a lenticular array.

FIG. 4 shows a security element 10 in which the masking structure 13 is composed of two superposed layers 13*a* and 13*b* containing the nanoscale fillers and the multilayer interferential pigment, respectively. These two layers may be applied one on the other.

The security element may take the form of a security thread integrated entirely into the bulk of the substrate of the security document. In this case, the masking layer is advantageously applied to both faces of the thread in order to mask the latter in reflection and allow it to be observed under transmitted light.

Figure 5:
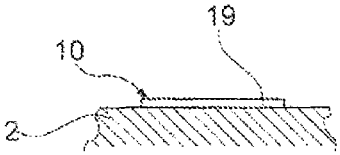
FIG. 5 shows in cross section a variant secured document according to the invention.

Although the invention is particularly advantageously applicable to a security thread, the security element 10 may also take the form of a foil or a patch applied to the surface of the substrate 2 of the document 1, as illustrated in FIG. 5.

The masking structure according to the invention then makes it possible to make the interior face 19 of the element 10, i.e. that face which is turned toward the substrate 2, less visible when the masking structure is interposed between the substrate 2 and the one or more layers of the security element to be hidden.

Figure 6:
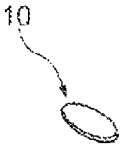
FIG. 6 shows in isolation a variant security element.

In the example in FIG. 6, the security element 10 takes the form of a flake. The masking structure may extend over both the major faces of the flake. The latter may comprise a luminescent and especially fluorescent compound.

In another variant, the security element takes the form of an especially colored magnetic and/or metal fiber.

Although the invention is preferably applied to a paper substrate that is white in color, the substrate may be slightly colored.

In this case, the masking layer may be substantially white or have the same slight coloring. The color of the masking layer may be adjusted by adjusting the color of the mixture of the nanoscale fillers and, if needs be, the color of iridescence of the multilayer interferential pigment.

The expression "comprising a" must be understood as being synonymous with "comprising at least one", unless otherwise specified.

The invention claimed is:

1. A security element for a secured document, comprising:

a security structure comprising an opaque layer, the opaque layer comprising at least one opening; and a masking structure, superposed at least partially on the security structure, for decreasing visibility of a surface of the security element in reflected light, the security element being present within the secured document or on a surface of the secured document, the masking structure comprising a mixture of at least two nanoscale fillers of one or more pulverulent compounds, a D50 average size of the at least two nanoscale fillers ranging from 1 nm to 1000 nm, and one of said at least two nanoscale fillers comprising pyrogenated colloidal silica, wherein the security element is visible under transmitted light through the masking structure.

2. The security element as claimed in claim 1, the security element forming a security thread, a foil, a patch, a flake, or a fiber.

3. The security element as claimed in claim 1, the security element having two opposite major faces, wherein the masking structure decreases visibility of at least one of said faces in reflected light.

4. The security element as claimed in claim 1, said at least two nanoscale fillers each having a D50 size ranging from 30 nm to 1000 nm.

5. The security element as claimed claim 1, said at least two nanoscale fillers having different refractive indices.

6. The security element as claimed in claim 1, said colloidal silica being present in an amount by weight ranging from 20% to 80% relative to the weight of the masking structure.

7. The security element as claimed in claim 1, one of said at least two nanoscale fillers comprising titanium dioxide.

8. The security element as claimed in claim 7, said titanium dioxide being present in an amount by weight ranging from 1% to 40% relative to a sum of the weights of said at least two nanoscale fillers.

9. The security element as claimed in claim 1, a thickness (t) of the masking structure ranging from 2 microns to 30 microns.

10. The security element as claimed in claim 1, the nanoscale fillers being dispersed in a binder within a layer of the masking structure.

11. The security element as claimed in claim 1, comprising a carrier made of a thermoplastic material.

12. The security element as claimed in claim 11, the security structure being located on one side of the carrier and the masking structure on the other side.

13. The security element as claimed in claim 11, the security structure and the masking structure being located on a same side of the carrier.

14. The security element as claimed in claim 1, said masking structure further comprising a multilayer interferential pigment comprising a mineral base coated with at least one layer of a refractive index different from that of the mineral base.

15. The security element as claimed in claim 14, an amount by weight of multilayer interferential pigment relative to the weight of the masking structure ranging from 1% to 40%.

16. The security element as claimed in claim 14, a size of the multilayer interferential pigment ranging from 2 microns to 150 microns.

17. The security element as claimed in claim 1 further comprising a luminescent agent, mixed in a layer of the masking structure.

18. The security element as claimed in claim 1, comprising a heat-sealing adhesive making contact with the masking structure.

19. The security element as claimed in claim 18, the heat-sealing adhesive comprising a luminescent.

20. The security element as claimed in claim 1, comprising a luminescent agent within a layer distinct from the masking structure.

21. A document incorporating the security element as claimed in claim 1.

22. The security element as claimed in claim 1, the at least one opening forming a negative script.

23. The security element as claimed in claim 1, the masking structure being superposed entirely on the security structure.

* * * * *